US006133559A

United States Patent [19]

Park

[11] Patent Number: 6,133,559

[45] Date of Patent: Oct. 17, 2000

[54] METHOD AND APPARATUS FOR ADJUSTING COOKING TEMPERATURE IN A MICROWAVE OVEN

[75] Inventor: Won Kyung Park, Kyungnam, Rep. of Korea

[73] Assignee: LG Electronics Inc., Seoul, Rep. of Korea

[21] Appl. No.: 09/222,931

[22] Filed: Dec. 30, 1998

[30] Foreign Application Priority Data

Dec. 31, 1997 [KR] Rep. of Korea ..... 97-80676

[51] Int. Cl.[7] ..... H05B 6/50

[52] U.S. Cl. ..... 219/710; 219/497

[58] Field of Search ..... 219/710, 711, 219/719, 704, 492, 325, 720, 708, 757

[56] References Cited

U.S. PATENT DOCUMENTS

| | | | |
|---|---|---|---|
| 4,009,359 | 2/1977 | Tallmadge et al. | 219/705 |
| 4,107,501 | 8/1978 | Ironfield | 219/710 |
| 4,213,023 | 7/1980 | Satoh et al. | 219/710 |
| 4,383,157 | 5/1983 | Nakata et al. | 219/711 |
| 4,471,193 | 9/1984 | Walter | 219/712 |
| 4,484,050 | 11/1984 | Horinouchi et al. | 219/712 |
| 4,894,502 | 1/1990 | Oh | 219/710 |
| 4,899,026 | 2/1990 | Oh | 219/710 |
| 5,134,263 | 7/1992 | Smith et al. | 219/682 |
| 5,302,793 | 4/1994 | Wouch et al. | 524/261 |
| 5,530,229 | 6/1996 | Gong et al. | 219/711 |
| 5,796,081 | 8/1998 | Carlsson et al. | 219/711 |
| 5,919,389 | 7/1999 | Uehashi et al. | 219/711 |
| 5,973,300 | 10/1999 | Tomohiro | 219/497 |

*Primary Examiner*—Teresa Walberg
*Assistant Examiner*—Jeffrey Pwu

[57] ABSTRACT

A first highest temperature of a load is detected during a current cycle. A second highest temperature of the load is detected during a last cycle. An actual temperature of the load is estimated in real time based on a gradient between the first and second highest temperatures. The estimated actual temperature and an actual temperature of the load detected by a sensor are compared to each other in real time, and the higher temperature is set as a current temperature. A heating operation is continued until the current temperature reaches a preset temperature.

4 Claims, 7 Drawing Sheets

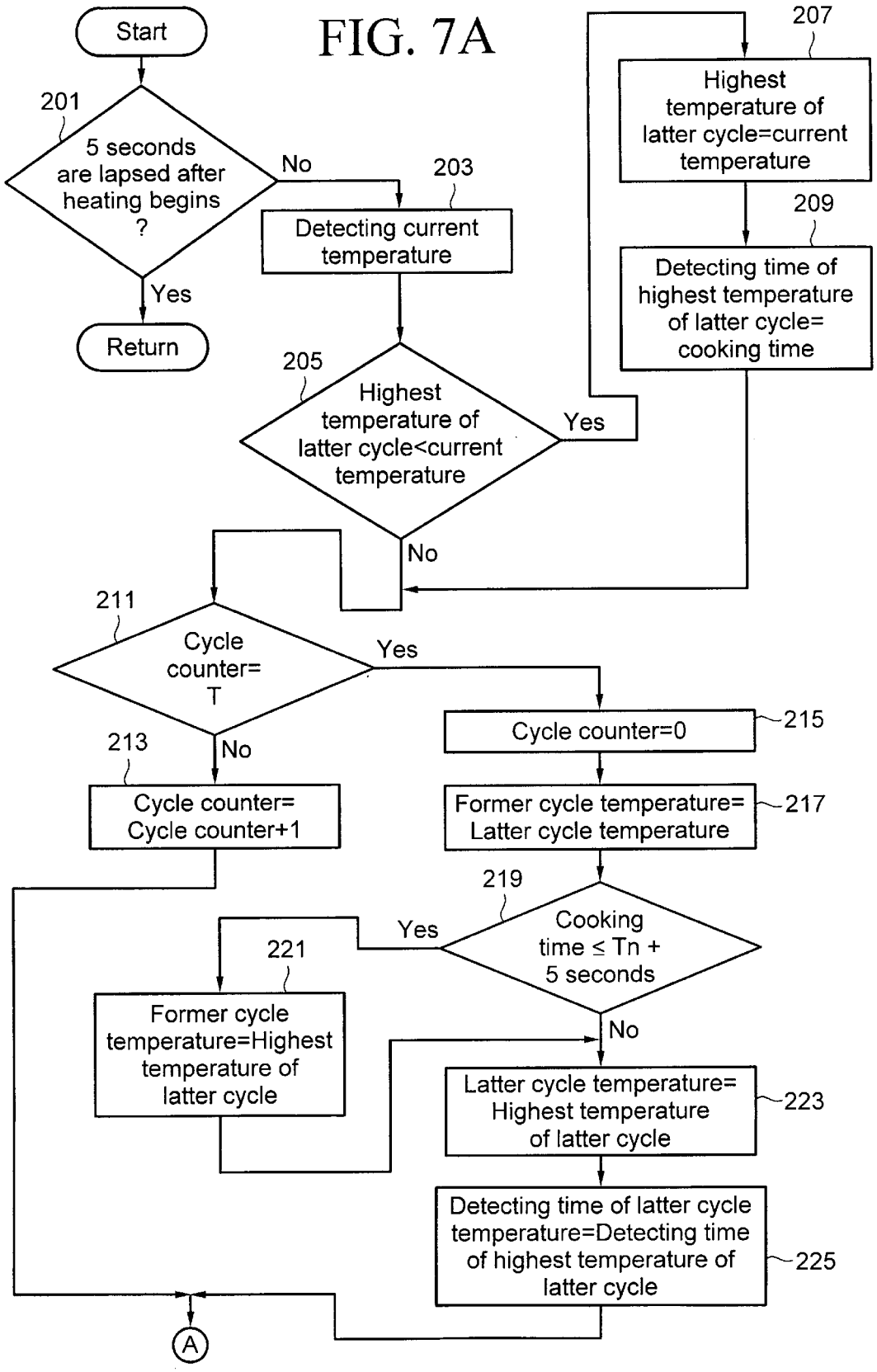
FIG. 7A
Start
201
5 seconds are lapsed after heating begins ?
No
Yes
Return
203
Detecting current temperature
205
Highest temperature of latter cycle<current temperature
Yes
No
207
Highest temperature of latter cycle=current temperature
209
Detecting time of highest temperature of latter cycle= cooking time
211
Cycle counter= T
Yes
No
213
Cycle counter= Cycle counter+1
215
Cycle counter=0
217
Former cycle temperature= Latter cycle temperature
219
Cooking time ≤ Tn + 5 seconds
Yes
No
221
Former cycle temperature=Highest temperature of latter cycle
223
Latter cycle temperature= Highest temperature of latter cycle
225
Detecting time of latter cycle temperature=Detecting time of highest temperature of latter cycle
A

METHOD AND APPARATUS FOR ADJUSTING COOKING TEMPERATURE IN A MICROWAVE OVEN

BACKGROUND OF THE INVENTION

1. Field of the Invention

The present invention relates to a method and an apparatus for adjusting a cooking temperature in a microwave oven, and more particularly, the present invention relates to a method and an apparatus for adjusting a cooking temperature of a microwave oven, which can compensate for temperature differences caused when detecting the temperature of food on a rotating turntable in the microwave oven.

2. Description of Related Art

Generally, a microwave oven is widely used. Accordingly, a higher level of functionality is in demand because it is crucial to ensure reliability in end products. With the availability of various types of pre-cooked and quick cooking food, a microwave oven serves as a cooking utensil which can quickly and easily perform cooking operations in an office or a convenience store, as well as home.

When a microwave oven performs cooking operations, a specific sensor means is used to control a heating operation. For example, when a microwave oven has an infrared sensor, food temperature is detected by the infrared sensor, and heating time is controlled based on the detected temperature. Also, when a microwave oven has a humidity sensor, humidity is detected by the humidity in the oven sensor, and heating time is controlled based on the detected humidity.

FIGS. 1 and 2, show front views of a conventional microwave oven, and FIG. 3 is a block diagram illustrating a discriminating mechanism in a conventional microwave oven.

A sensor hole 4 is formed at an upper portion of one of side walls of cooking compartment 1. An infrared sensor 5 is mounted in the microwave oven to remotely detect a temperature of a food load 7 located in the cooking compartment 1 through the sensor hole 4. A signal from the infrared sensor 5 is inputted to discriminating mechanism 6. The discriminating mechanism 6 controls a heating operation of heating device 3, which generates microwaves and controls operation of other oven components, based on the signal from the infrared sensor 5.

A turntable driving motor 8 is mounted below the cooking compartment 1, and is driven under a control of the discriminating mechanism 6. A turntable 2 is fixed to a shaft of the turntable driving motor 8 centrally disposed in the cooking compartment 1. The load 7 including food to be cooked is put on the turntable 2.

According to the conventional microwave oven constructed as mentioned above, the discriminating mechanism 6 controls the heating device 3 and the turntable driving motor 8 based on the signal detected by the infrared sensor 5. Therefore, the food load 7 positioned in the cooking compartment 1 is heated by the microwaves generated by the heating device 3. The turntable 2 rotates while the heating device 3 is operates, to distribute microwave energy to the food load 7.

Referring to FIG. 3, the discriminating mechanism 6 includes a key input section 6*a* for inputting an intended cooking temperature, cooking time, and a cooking mode, a preset temperature memory 6*b* for storing the intended cooking temperature inputted through the key input section 6*a* (or a preset temperature), a current temperature memory 6*c* for temporarily storing a current temperature detected by the infrared sensor 5, a display section 6*d* for displaying (through a liquid crystal display) a simple message including the preset temperature, the current temperature, the cooking time, etc., and an output control section 6*e* for controlling an output by comparing the current temperature with the preset temperature.

The discriminating mechanism 6 discriminates the current temperature of the load 7 based on the signal detected by the infrared sensor 5. The discriminating mechanism 6 performs cooking operation by actuating the heating device 3 until the detected current temperature reaches the preset temperature.

While the FIG. 1 shows the load 7 centrally positioned on the turntable 2, FIG. 2 shows the load 7 offset from a center of the turntable 2.

Hereinafter, the cooking operation of a conventional microwave oven, constructed as mentioned above, will be described in detail.

FIG. 4, is a flow chart for explaining a cooking operation of the conventional microwave oven.

A user puts the load 7 onto the turntable 2 in the cooking compartment 1, inputs the cooking temperature through the key input section 6*a* to store the cooking temperature as the preset temperature into the preset temperature memory 6*b*, and presses a cooking start key. At this time, the output control section 6*e* actuates the heating device 3 to heat the load 7. The output control section 6*e* is maintained in a stand-by state for about 5 seconds after heating of the load 7 begins, without sensing the temperature of the load 7 with the infrared sensor 5, to prevent an error from being induced on the detected temperature due to oscillating noise, etc. (step 110).

The temperature of the load 7 put in the cooking compartment 1 rises as the heating operation of the heating means 3 proceeds. The output control section 6*e* begins to receive the temperature signal detected by the infrared sensor 5 after a predetermined time (for example, about 5 seconds) elapses since the start of the heating operation (step 120).

The output control section 6*e* compares the current temperature of the load 7, which is detected by the infrared sensor 5, with the preset temperature (step 130). If the current temperature is lower than the preset temperature, the output control section 6*e* continues to actuate the heating device 3 thereby to heat the load 7. If the current temperature reaches the preset temperature, the output control section 6*e* stops the operation of the heating device 3 to complete the cooking operation (step 140).

In other words, in the cooking operation of the conventional microwave oven of the prior art, the current temperature of the load 7, which is detected by the infrared sensor 5, is compared with the preset temperature. If the current temperature is lower than the preset temperature, the heating device 3 continues to heat the load 7. If the current temperature reaches the preset temperature, the operation of the heating device 3 is stopped to complete the cooking operation.

However, in the conventional microwave, even when the same food is cooked under the same cooking conditions, actual food temperatures may be different at different times when the cooking operations is completed. This is because the current temperature detected by the infrared sensor 5 varies depending on rotation of the turntable 2.

That is, as shown in FIG. 1, when the load 7 is centrally positioned on the turntable 2, when the current temperature of the load 7 reaches the preset temperature, cooking is completed. The current temperature of the load 7 depends on the rotating cycle of the turntable 2 with the load 7 is centrally positioned on the turntable 2.

However, with the load 7 is offset from the center of the turntable 2, the load 7 the may emit more heat or less heat relative to infrared sensors when compared to the state as shown in FIG. 1.

As a result, the load 7 can be more highly heated for turntable rotation cycle time (generally, between about 10 through 24 seconds) (denoted as "dT" in FIG. 5) of the turntable 2 from a time when an actual temperature of the load 7 reaches the preset temperature. This is because the current temperature detected by the infrared sensor 5 varies in synchronization with the rotation cycle of the turntable 2.

Generally, a highest temperature among temperatures detected by the infrared sensor 5 is close to the actual temperature of the load 7. However, even when the actual temperature of the load 7 reaches the preset temperature at an initial stage of the rotating cycle of the turntable 2, the heating operation may continue until a corresponding rotating cycle of the turntable is completely ended.

This is because the discriminating mechanism 6 decides whether the current temperature reaches the preset temperature only when a highest temperature is detected during the corresponding rotating cycle of the turntable 2. Accordingly, the discriminating mechanism 6 continuously detects the temperature of the load 7 until the corresponding rotating cycle of the turntable 2 completely ends. For this reason, the heating operation controlled by the discriminating mechanism 6 is continuously performed until the corresponding rotating cycle of the turntable 2 is completely ended. Therefore, a time when the discriminating mechanism 6 decides that the current temperature reaches the preset temperature, may vary within the rotation cycle time (of about 10 through 24 seconds) from the time when the actual temperature actually reaches the preset temperature.

In particular, if the food load 7 is small, the temperature of the food can be raised to a great extent for the rotating cycle of the turntable 2. For this reason, the temperature of the food after cooking, may vary by a great extent from the preset temperature.

SUMMARY OF THE INVENTION

Accordingly, an object of the present invention is to provide a method and an apparatus for adjusting a cooking temperature in a microwave oven, which can compensate for a temperature difference generated by a rotating cycle of a turntable.

According to one aspect of the present invention, a method for adjusting a cooking temperature in a microwave ovenincludes detecting a first highest temperature of a load during a current turntable rotation cycle; detecting a second highest temperature of the load during a last turntable rotation cycle; estimating in real time an actual temperature of the load based on a slope between the first and second highest temperatures; comparing in real time the estimated actual temperature and an actual temperature of the load detected by a temperature sensor, and setting the higher one as a current temperature; and performing a heating operation until the current temperature reaches a preset temperature.

According, to another aspect of the present invention, an apparatus is providedcomprising: a detecting mechanism for detecting a temperature of a load; a first memory for storing a first highest temperature of the load detected by the detecting mechanism during a current turntable rotating cycle and a second highest temperature of the load detected by the detecting mechanism during a last turntable rotating cycle; a second memory for storing a preset temperature in accordance with a particular cooking mode; a third memory for storing an instantneous actual temperature of the load estimated based on a gradient between the first and second highest temperatures; and a controlling mechanism for comparing the presumed actual temperature and a detected actual temperature of the load detected by a sensor in real time, setting the higher of the two as a current temperature, and controlling a heating operation until the current temperature reaches the preset temperature.

In the present invention, the highest detected temperature of the load during the last rotating cycle of the turntable, which just precedes the current cycle, is referred to as a "latter cycle temperature", and a time when the latter cycle temperature is detected is referred to as a "latter cycle temperature detecting time". Also, another highest temperature of the load detected during one cycle before the last cycle of the turntable, is referred to as a "former cycle temperature". The gradient is calculated based on the former cycle temperature and the latter cycle temperature obtained in these ways, and the actual temperature is estimated using the slope.

In addition, according to the present invention, the estimated actual temperature and the detected actual temperature of the load are compared to each other, and the higher one is set as the current temperature. It is then discriminated whether the set current temperature reaches the preset temperature.

Hence, since the microwave oven of the present invention estimates an actual temperature of food based on a time when a highest temperature is detected while taking into account temperature variations during past rotating cycles of a turntable, it is possible to precisely control the temperature of the food.

BRIEF DESCRIPTION OF THE DRAWINGS

The above objects, and other features and advantages of the present invention will become more apparent after a reading of the following detailed description when taken in conjunction with the drawings, in which:

FIGS. 7*a* & 7*b* is a flow chart for explaining a method for adjusting a cooking temperature in a microwave oven, according to the present invention.

DETAILED DESCRIPTION OF PREFERRED EMBODIMENTS

Figure 1:
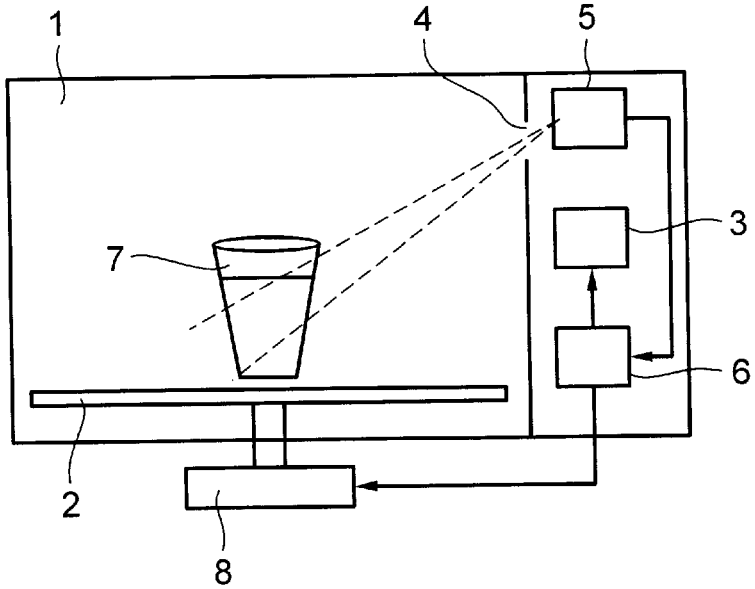
FIG. 1 Conventional Art
FIGS. 1 and 2 are front views illustrating a hardware construction of the conventional microwave oven.
Figure 2:
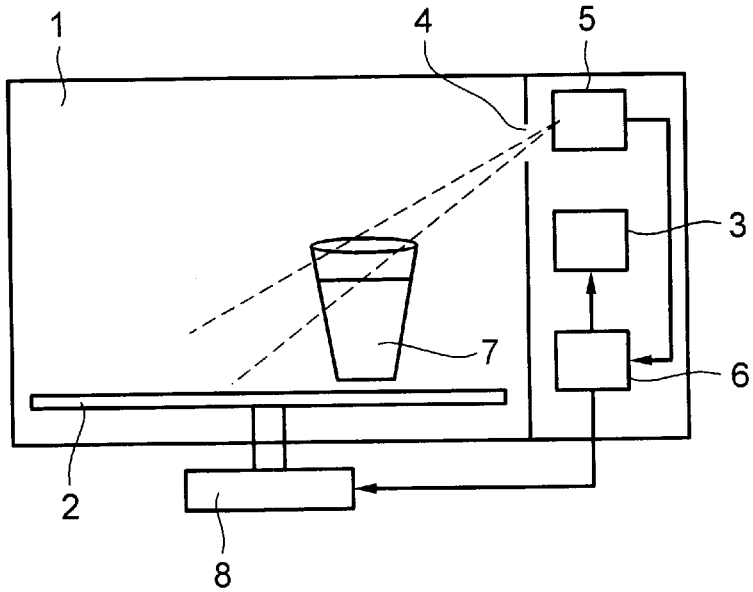
FIG. 2 Conventional Art
Figure 3:
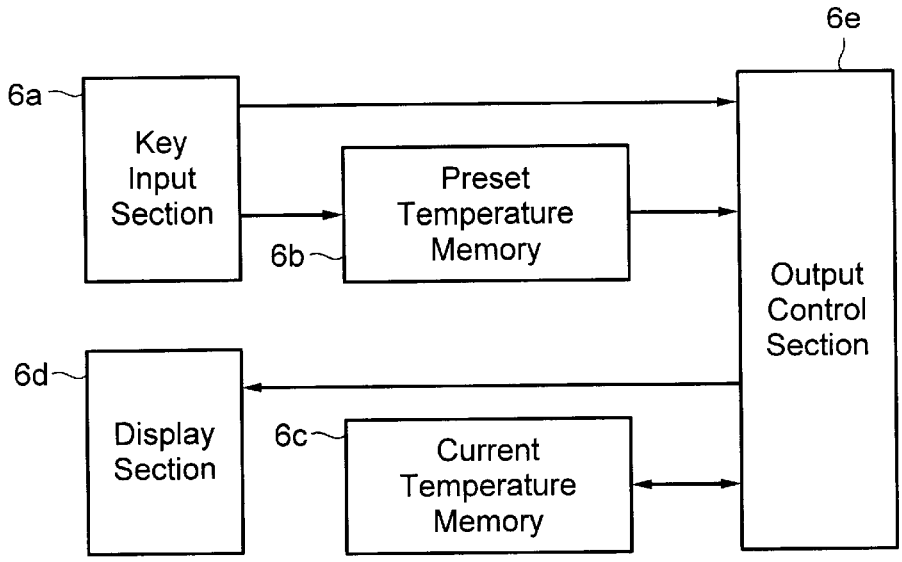
FIG. 3 Conventional Art
FIG. 3 is a block diagram illustrating a detailed construction of discriminating means of the conventional microwave oven of FIGS. 1 and 2.
Figure 4:
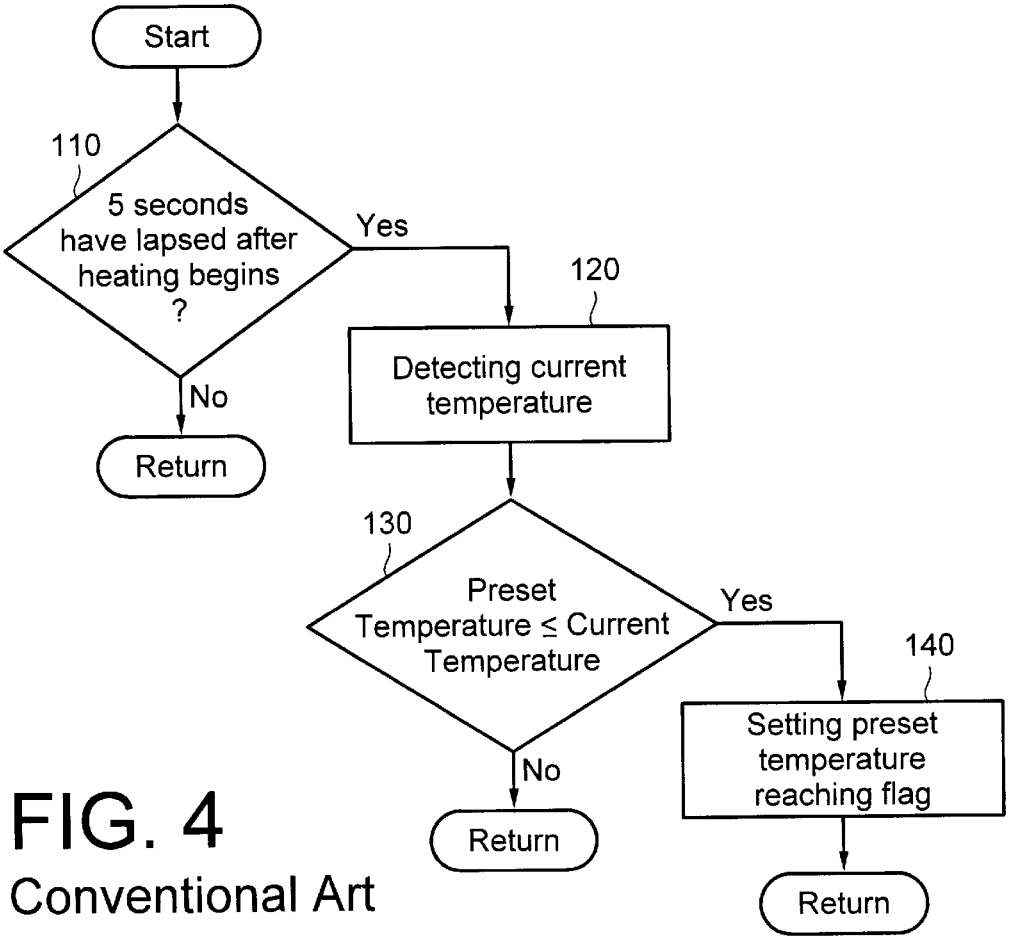
FIG. 4 Conventional Art
FIG. 4 is a flow chart for explaining cooking operations of the conventional microwave oven.
Figure 5:
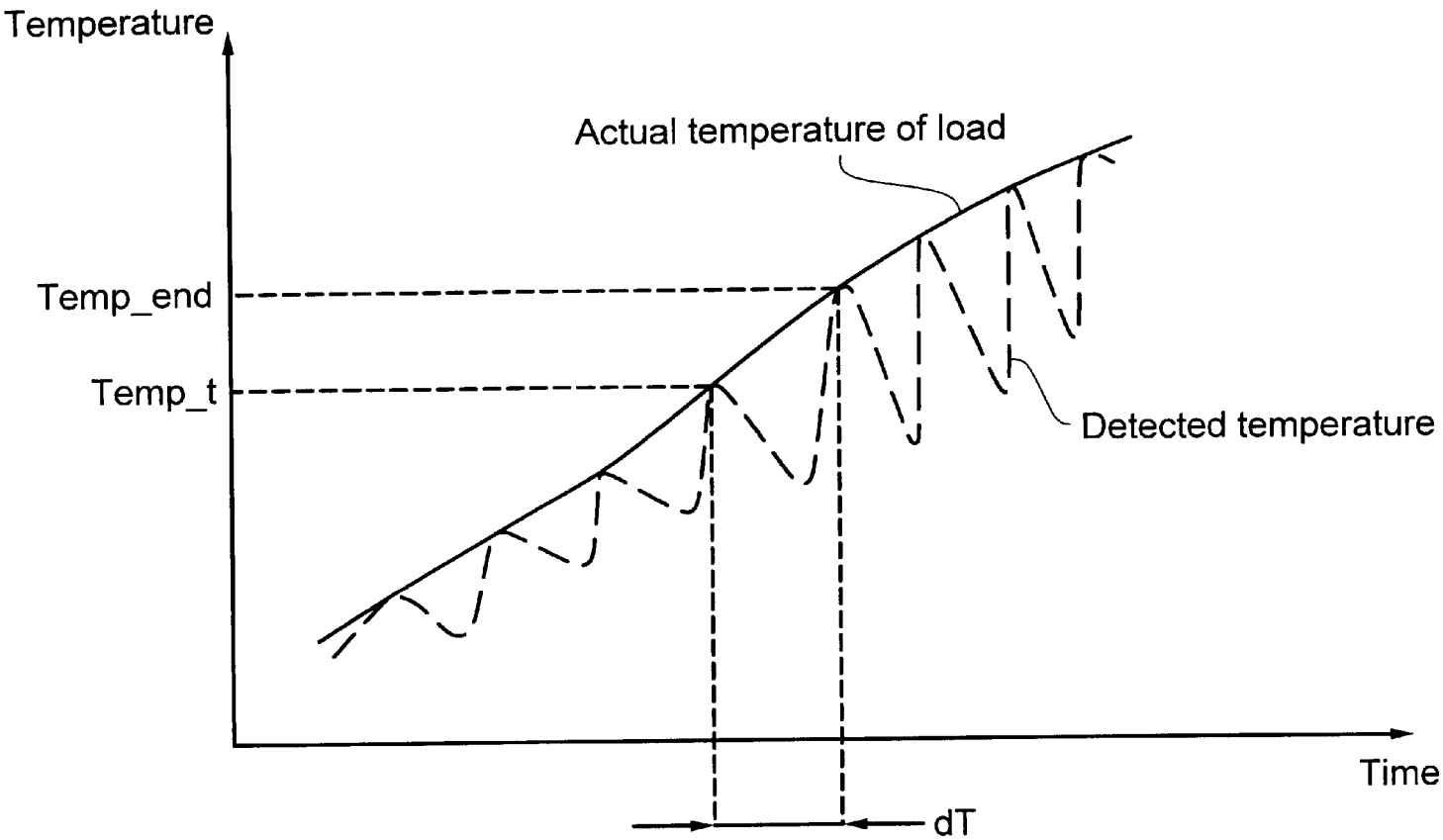
FIG. 5 Conventional Art
FIG. 5 is a graph illustrating a relationship between a detected temperature and an actual temperature of a load in the conventional microwave oven.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 6:
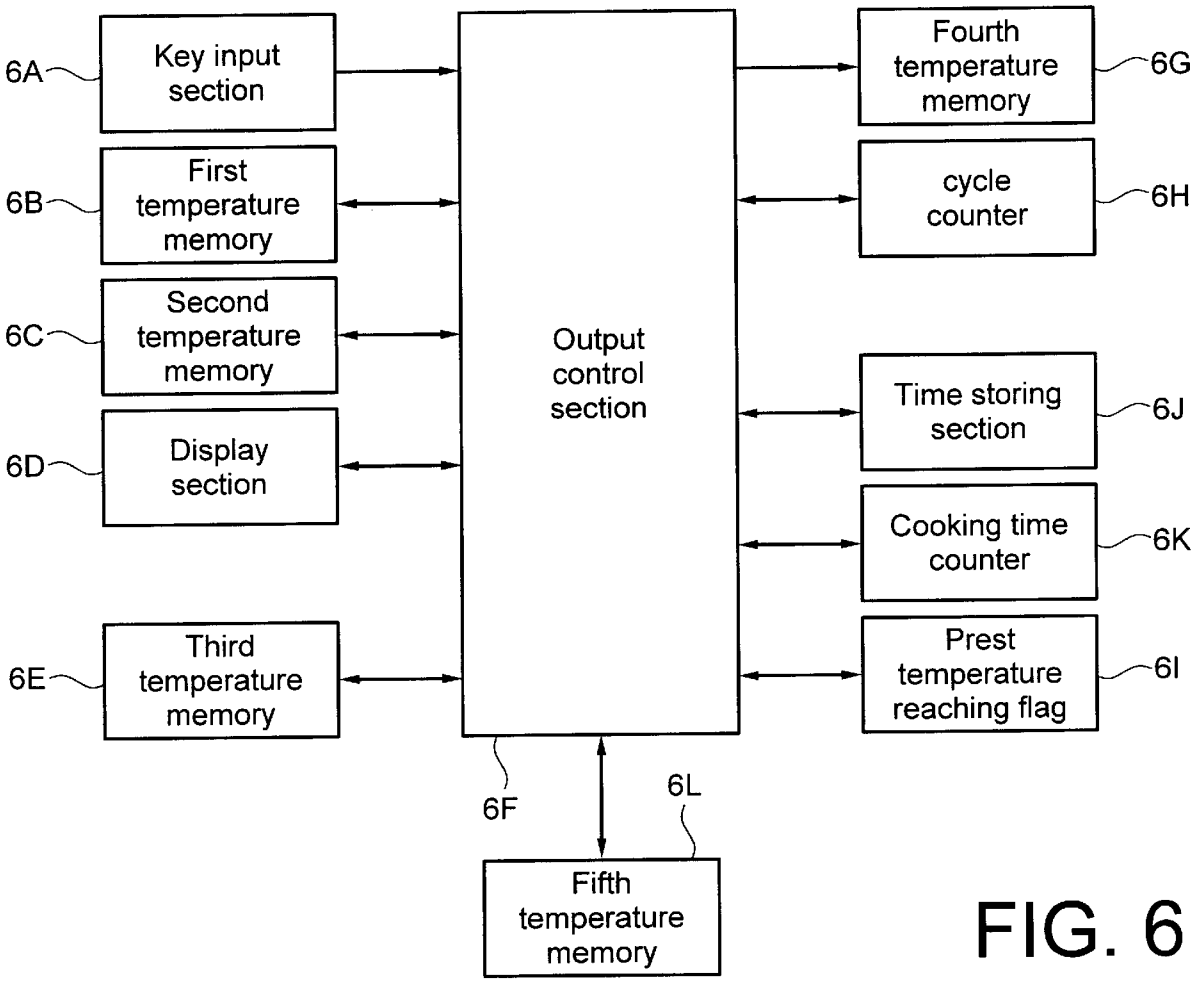
FIG. 6 is a block diagram illustrating a detailed construction of discriminating mechanism which provides a temperature compensating control in accordance with an embodiment of the present invention.

Hereinafter, a hardware construction of a microwave oven of the present invention will be described with reference to FIG. 1, and a detailed construction of discriminating mechanism according to the present invention will be described with reference to FIG. 6. Also, hereinafter, a highest temperature of a load detected during a last rotating cycle n−1 of a turntable 2, which just precedes a current cycle n, is referred to as a "latter cycle temperature", and a time when the latter cycle temperature is detected is referred to as a "latter cycle temperature" detecting time. Also, another highest temperature of the load detected during one before the last cycle n−2 of the turntable 2, which just precedes the last cycle n−1, is referred to as a "former cycle temperature".

In the microwave oven of the present invention, a sensor hole 4 is formed in an upper portion of one of side walls which define a cooking compartment 1. An infrared sensor 5 is mounted in the microwave oven to remotely detect a temperature of a load 7 located in the cooking compartment 1 through the sensor hole 4. A signal detected by the infrared sensor 5 is inputted to discriminating mechanism 6. The discriminating mechanism 6 controls a heating operation of heating device 3 which generates microwaves and control operation of all other components, based on the signal detected by the infrared sensor 5.

A turntable driving motor 8 is mounted below the cooking compartment 1, and is driven under control of the discriminating mechanism 6. A turntable 2 is fixed to a shaft of the turntable driving motor 8 centrally disposed in the cooking compartment 1. The load 7 which contains food to be cooked is put on the turntable 2.

The discriminating mechanism 6 (see FIG. 6) includes a key input section 6A for inputting a cooking temperature, a cooking time and a cooking start key, etc. A first temperature memory 6B stores the cooking temperature inputted through the key input section 6A and/or a preset temperature. A second temperature memory 6C stores a current temperature detected by the infrared sensor 5. A display section 6D displays the preset temperature, the current temperature, the cooking time, etc. Also, the discriminating 6 includes an output control section 6F for controlling an output by comparing the preset temperature and the current temperature. A timer 6K tracks the elapsed cooking time. A third temperature memory 6E stores a temperature of the load 5 during the second to last rotating cycle n−2. A fourth temperature for storing 6G stores a temperature of the load 5 during the last turntable rotating cycle n−1. Further, the discriminating mechanism 6 includes a cycle counter 6H for measuring turntable rotating cycle time, a time memory 6J for storing a time when the highest temperature of the last rotating cycle n−1 is detected, a preset temperature reaching flag 6I for flagging when the preset temperature is reached in the current cooking operation, and a fifth temperature memory 6L for storing an estimated temperature, based on a gradient between the prior turntable rotating cycle temperature and the latter rotating cycle temperature.

The discriminating mechanism 6 constructed as mentioned above, controls the cooking operation of the microwave oven in accordance with the preset temperature.

When a user presets the cooking temperature (preset temperature) with the key input section 6A the preset temperature is stored in the first temperature memory 6B under the control of the output control section 6F. At this time, the output control section 6F remembers the preset temperature until the current cooking operation is completed. Also, when the user presets the cooking time with through the key input section 6A, the output control section 6F remembers the preset cooking time. Thereafter, when the user presses the cooking start key, the output control section 6F controls the heating device 3 in accordance with the preset cooking time and the preset temperature to effect cooking as desired.

The temperature of the load 7 rises as the operation of the heating device 3 proceeds. The infrared sensor 5 remotely detects the temperature of the load 7 through the sensor hole 4. The output control section 6F stores the detected current temperature of the load 7 in the second temperature memory 6C, which is a current temperature memory.

Further, the highest temperature of the load 7 detected during the last turntable rotating cycle n−1, which just precedes the current turntable rotating cycle n, is stored as the latter cycle temperature in the fourth temperature memory 6G. Also, the time when the latter cycle temperature is detected, (i.e., the latter cycle temperature detecting time), is stored in the time memory 6J.

In addition, the highest temperature of the load 7 detected during the next to the last turntable rotating cycle n−2 of the turntable 2, which just precedes the last turntable rotating cycle n−1 (in which the latter cycle temperature is detected), is stored in the third temperature memory 6E as the former cycle temperature.

The output control section 6F calculates the gradient based on the former rotating cycle temperature and the latter rotating cycle temperature, and determines the estimated temperature based on the calculated gradient. This estimated temperature is stored in the fifth temperature memory 6L.

The output control section 6F compares the estimated temperature stored in the fifth temperature memory 6L and the current temperature stored into the second temperature memory 6C, and identifies the a higher one as the actual current temperature of the load 7. Then, the output control section 6F controls the cooking operation for the preset cooking time while comparing the determined actual current temperature and the preset temperature stored into the first temperature memory 6B until the actual current temperature reaches the preset temperature.

Hereinbelow, a method for adjusting cooking temperature the microwave oven constructed as mentioned above will be described in detail.

Figure 7B:
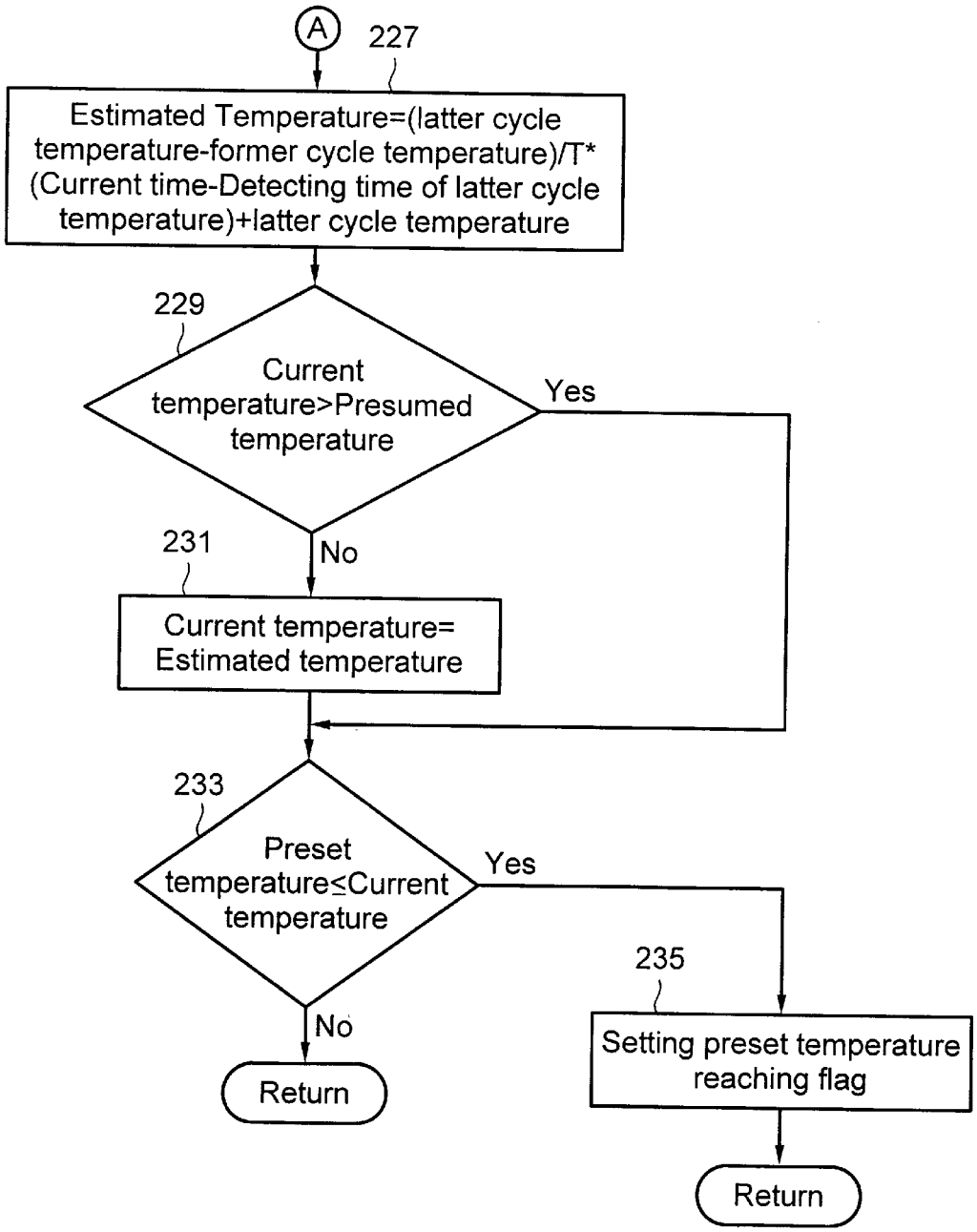
Figure 8:
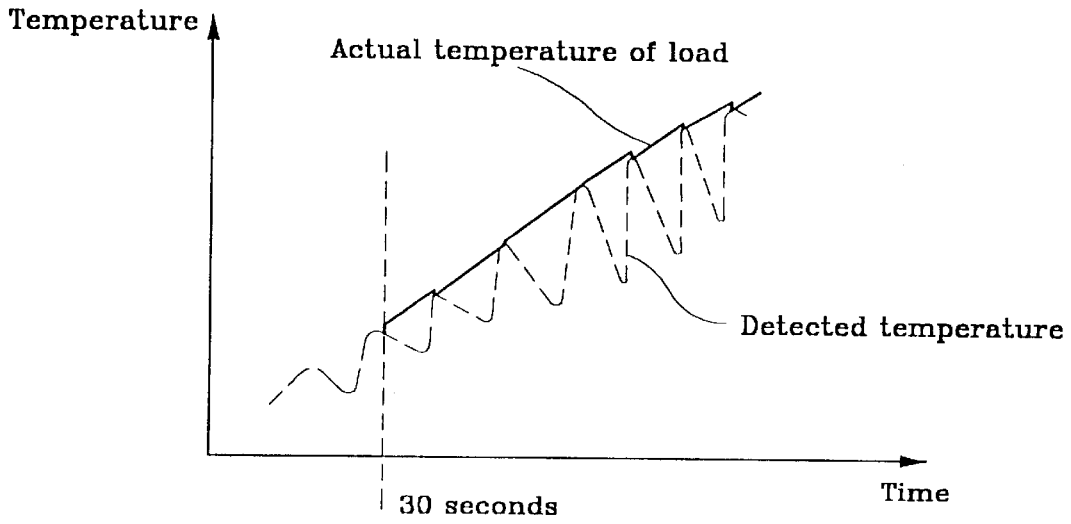
FIG. 8 is a graph illustrating a relationship between a detected temperature of a load and an actual temperature of the load in the microwave oven of the present invention.

Referring to FIG. 7, there is shown a flow chart for explaining a method for compensating a temperature according to a microwave oven, according to the present invention, and FIG. 8 is a graph illustrating a relationship between a detected temperature and an actual temperature of a load in the microwave oven of the present invention.

When the user puts the load 7 onto the turntable 2 in the cooking compartment 1 and inputs the cooking temperature through the key input section 6A, the preset temperature is stored into the first temperature memory 6B. Thereafter, when the user presses the cooking start key, the output control section 6F actuates the heating device 3 to heat the load 7. The output control section 6F is maintained in a stand-by state for about 5 seconds after starting to heat the load 7, without sensing the temperature of the load 7 through the infrared sensor 5, this prevents errors from being induced in the detected temperature due to oscillating signal noise, etc. (step 201).

The temperature of the load 7 rises because of the continuous heating, and the output control section 6F receives the temperature detected by the infrared sensor 5 (step 203).

The output control section 6F compares the current temperature detected by the infrared sensor 5 with the latter cycle temperature (which is the highest temperature detected during the last turntable rotating cycle n−1 of the turntable 2) (step 205). The output control section 6F compares the current temperature with the latter cycle temperature, because the latter cycle temperature is the highest temperature among temperatures detected up to the current time.

The output control section 6F stores a higher of the two temperatures, compared to each other, as the latter cycle temperature in the fourth temperature memory 6G (step 207). Of course, as described above, the highest temperature detected during the last turntable rotating cycle n−1 is considered as the latter cycle temperature. However, this is just one way in which information needed to calculate the gradient is expressed (namely, former cycle temperature or latter cycle temperature), as will be described in step 227. As a result, this is similar to the fact that when the next turntable rotating cycle n proceeds, the highest temperature detected during the current turntable rotating cycle n−1 is set as the latter cycle temperature. Further, the time when the highest temperature is obtained is detected in step 207 and is stored into the time memory 6J (step 209).

The procedures of step 205 through step 209 for storing the highest temperature as the latter cycle temperature are repeated until the cycle counter 6H for counting the turntable rotating cycle time 2 outputs a signal corresponding to the completion of one rotating cycle (step 211). The cycle counter 6H increases by 1 every time the current temperature detected by the infrared sensor 5 and the highest temperature of the last turntable rotating cycle are compared to each other, and the higher one is set as the latter cycle temperature (step 213). Although, the cycle time T of the cycle counter 6H can be set to the turntable rotating cycle time of the turntable 2, the cycle time T of the cycle counter 6H can be also set to a value in which a predetermined amount is added to the turntable rotating cycle time of the turntable 2.

When the cycle counter 6H outputs the signal which corresponds with the completion of one rotating cycle of the turntable 2, the cycle counter 6H is initialized to a value of "0" (step 215).

At this time, the latter cycle temperature stored in the fourth temperature memory 6G is substituted for the former cycle temperature and is stored in the third temperature memory 6E (step 217).

The output control section 6F decides whether a counting value of the cycle counter 6K corresponds to a time which is obtained by multiplying the cycle time T of the turntable 2 by a number of cycles n and then adding 5 seconds (step 219). The 5 seconds is the time during which the output control section 6F is maintained in a stand-by state, as discussed above. Accordingly, if an answer in step 219 is NO, it is discriminated by the output control section 6F that the complete rotation of the turntable 2 has not occurred.

However, if the answer in step 219 is YES, the output control section 6F substitutes the latter cycle temperature stored in the fourth temperature memory 6G for the former cycle temperature to store into the third temperature memory 6E (step 221). At the same time, the output control section 6F sets an initial value of the fourth temperature memory 6G equal to the latter cycle temperature (step 223). Then, the time when the highest temperature is detected during the last cycle, is stored into the time memory 6J (step 225).

The data stored into the fourth temperature memory 6G is set as the latter cycle temperature in step 223 to set the highest temperature detected during a previous turntable rotating cycle as a reference value to be compared with a temperature detected during a subsequent turntable rotating cycle, before the rotation of the turntable 2 in the subsequent rotating cycle is initiated. Accordingly, in this case, the data stored in the third and fourth temperature memories 6E and 6G are set as the same latter cycle temperatures.

When a turntable rotating cycle is completed through the above described procedure, since steps 221 through 225 are just completed, it will be readily understood that the former cycle temperature and the latter cycle temperature become identical to each other. Also, within the turntable rotating cycle, in the course of performing steps 205 thorough 213, it can be presumed that the former cycle temperature and the latter cycle temperature may be set such that they are different from each other.

Through the above described procedures, the highest temperature detected during the last turntable rotating cycle is stored in the fourth temperature memory 6G, and the highest temperature detected during the next to the last cycle is stored in the third temperature memory 6E. Further, the time when the latter cycle temperature is detected is stored in the time memory 6J.

Then, the output control section 6F calculates the estimated temperature by the following equation based on the gradient between the former cycle temperature and the latter cycle temperature by using the latter cycle temperature, the former cycle temperature, the latter cycle temperature detecting time and the current time (step 227).

Estimated temperature=(latter cycle temperature−former cycle temperature)/T×(current time−latter cycle temperature detecting time)+latter cycle temperature.

The estimated temperature is calculated in step 227 based on the gradient between the latter cycle temperature and the former cycle temperature. The output control section 6F stores the estimated temperature as described above in the fifth temperature memory 6L.

Further, the output control section 6F compares the estimated temperature stored in the fifth temperature memory 6L with the current detected temperature of the load 7 detected by the infrared sensor 5 and stored in the second temperature memory 6C (step 229), and sets the higher temperature as the actual current temperature of the load 7.

Thus, if the estimated temperature is higher than the current detected temperature in step 229, the estimated temperature becomes the actual current temperature (step 231). However if the current temperature is higher than the estimated temperature, the current detected temperature becomes the actual current temperature.

The output control section 6F compares the actual current temperature set in step 231 with the preset temperature stored in the first temperature memory 6B (step 233). If the actual current temperature reaches the preset temperature, the preset temperature reaching flag 6I is set to complete the cooking operation (step 235).

However, if the actual current temperature is lower than the preset temperature in step 233, the output control section 6F returns to step 203 to read out the current temperature detected by the infrared sensor 5. In this case, the heating operation of the heating device 3 continues under the control of the output control section 6F.

When the output control section 6F returns to step 203, the output control section 6F in step 205 compares the current temperature detected by the infrared sensor 5 with the highest temperature detected during the last turntable rotating cycle and stored in the fourth temperature memory 6G, and presets a higher one as the latter cycle temperature and stores the latter cycle temperature again in the fourth temperature memory 6G (step 207).

The above procedure is performed until one turntable rotating cycle is completed (step 211). Even before the one turntable rotating cycle is completed, the estimated temperature is continuously calculated in step 227 using the latter cycle temperature stored in the fourth temperature memory 6G, the former cycle temperature stored in the third temperature memory 6E, and the latter cycle temperature detecting time, etc.

In step 229, the estimated temperature is compared with the current temperature detected by the infrared sensor 5, and the higher temperature is set as the actual current temperature. The actual current temperature is then compared with the preset temperature (step 233).

If the actual current temperature does not reach the preset time while step 233 is repeated, the output control section 6F continues to detect the current temperature using the infrared sensor 5, while monitoring a counting value of the cycle counter 6H (step 211).

When the cycle counter 6H outputs the signal corresponding to the completion of one turntable rotating cycle time T in step 211, then if the actual current temperature does not reach the preset temperature, the latter cycle temperature stored in the fourth temperature memory 6G is stored in the third temperature memory 6E (step 217). Then, a temperature detected based on the latter cycle temperature stored in the fourth temperature memory 6G is compared with the estimated temperature, and a procedure in which a higher one is compared with the preset temperature is performed.

FIG. 8, illustrates a relationship between a detected temperature and an actual temperature of a load in the microwave oven of the present invention.

According to the present invention, the load 7 is put in the cooking compartment 1 of the microwave oven having the infrared sensor 5. The temperature is then set through the key input section 6A. The preset temperature is stored in the first temperature memory 6B. The cooking operation is then started. Thereafter, the output control section 6F reads out the current temperature of the load 7 detected by the infrared sensor 5 during the rotating cycle of the turntable 2. The highest temperature of the load 7 detected during the last turntable rotating cycle is referred to as the latter cycle temperature, and the time when the latter cycle temperature is detected is referred to as latter cycle temperature detecting time. Also, the highest temperature of the load 7 detected during the cycle before the last cycle is referred to as the former cycle temperature. The estimated temperature is calculated by the following equation using the gradient between the former cycle temperature and the latter cycle temperature.

Estimated temperature=latter cycle temperature−former cycle temperature)/T×(current time−latter cycle temperature detecting time)+latter cycle temperature.

The estimated temperature calculated as described above is compared with the current temperature detected by the infrared sensor 5, and a higher of the two temperatures is set as the actual current temperature. Then, the actual current temperature of the load and the preset temperature are compared to each other to determine whether the actual current temperature has reached the preset temperature.

As described above, according to the present invention, a temperature of a load in the microwave oven is estimated in real time, so it is possible to precisely control a cooking temperature of the microwave oven. In particular, even if an amount of food present is small, the food is prevented from overheating after the cooking operation is completed.

In the drawings and specification, typical preferred embodiments of the present invention are disclosed and, although specific terms are employed, they are used in a generic and descriptive sense only and not for purposes of limitation, the scope of the invention being set forth in the following claims.

What is claimed is:

1. A method for controlling a temperature of a load in an oven, comprising:

detecting a highest temperature of the load during a current time cycle;

detecting a highest temperature of the load during a prior time cycle immediately preceding the current time cycle;

estimating an actual temperature of the load based on the gradient between the highest temperature during the current time cycle and the highest temperature during the prior time cycle;

comparing the estimated actual temperature of the load and a detected actual temperature of the load and defining the higher of the two as a current temperature of the load; and continuing a heating operation of the oven until the current temperature of the load at least equals a preset temperature value.

2. The method according to claim 1, wherein the estimated actual temperature of the load equals: ((the highest temperature of the current time cycle−the highest temperature of the prior time cycle)/time length of the time cycle) *(current time−time at which the highest temperature of the current time cycle is detected)+(the highest temperature of the current time cycle).

3. The method according to claim 1, wherein the oven is a microwave oven including a rotating turntable therein, wherein the current and prior time cycles are rotation cycles of the turntable.

4. An apparatus for controlling a temperature of a load in an oven, comprising:

a temperature detector for detecting a temperature of the load;

a first memory for storing the highest temperature of the load detected by said temperature detector during a current time cycle and the highest temperature of the load detected by said temperature detector during a prior time cycle immediately prior to said current time cycle;

a second memory for storing a preset temperature value;

a third memory for storing an estimated actual temperature of the load, said estimated actual temperature being obtained from a gradient between the highest temperature of said current time cycle and the highest temperature of said prior time cycle; and an oven controller for comparing said estimated actual temperature of the load and said detected actual temperature of the load detected by said temperature sensor, defining the higher of the two temperatures as a current temperature of the load, and continuing a heating operation of the oven until said current temperature of the load at least equals said preset temperature.

* * * * *